US007991343B2

(12) United States Patent
Izawa et al.

(10) Patent No.: US 7,991,343 B2
(45) Date of Patent: Aug. 2, 2011

(54) PHOTOCONDUCTOR DRUM CLEANING APPARATUS IN AN ELECTROPHOTOGRAPHIC PRINTER

(75) Inventors: Hideo Izawa, Narashino (JP); Junichi Setoyama, Narashino (JP); Nobuyuki Kikuchi, Yokote (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 422 days.

(21) Appl. No.: 12/331,317

(22) Filed: Dec. 9, 2008

(65) Prior Publication Data

US 2009/0169278 A1 Jul. 2, 2009

(30) Foreign Application Priority Data

Dec. 27, 2007 (JP) ..... 2007-336424

(51) Int. Cl.
*G03G 21/00* (2006.01)

(52) U.S. Cl. ..... 399/349; 399/249; 15/256.51

(58) Field of Classification Search ..... 399/249, 399/349; 15/256.51
See application file for complete search history.

(56) References Cited

FOREIGN PATENT DOCUMENTS

JP 2004-271833 9/2004
JP 2007011142 A * 1/2007

* cited by examiner

*Primary Examiner* — David M Gray
*Assistant Examiner* — G. M. Hyder
(74) *Attorney, Agent, or Firm* — Cohen Pontani Lieberman & Pavane LLP

(57) ABSTRACT

A photoconductor drum cleaning apparatus in an electrophotographic printer is disclosed which is simple in makeup, which allows a wiping roll to be rotated to follow rotation of the photoconductor drum is rotated and to be serviced for a prolonged life and is capable of performing an improved cleaning operation. To this end, the photoconductor drum 1 comprises: disposed in order from upstream in the direction of the photoconductor drum, a blade scraper 11 contacting with the surface of the rotating photoconductor drum and a wiping roll 12 rotating reversely in rubbing contact with the surface of the rotating photoconductor drum; disposed upstream of an area of rubbing contact of the rotating wiping roll with the photoconductor drum, a squeezing roll 13 rotating normally in pressure contact with the surface of the rotating wiping roll; and disposed downstream of an area of rubbing contact of the rotating wiping roll with the photoconductor drum and upstream of the rotating squeeze roll, a brush roll 14 rotating normally or reversely in pressure contact with the surface of the rotating wiping roll, the brush roll having a portion of its outer periphery immersed in a cleaning carrier solution.

8 Claims, 3 Drawing Sheets

PHOTOCONDUCTOR DRUM CLEANING APPARATUS IN AN ELECTROPHOTOGRAPHIC PRINTER

TECHNICAL FIELD

The present invention relates to a photoconductor drum cleaning apparatus in an electrophotographic printer whereby a carrier liquid and toner that remain on the surface of a photoconductor drum in the electrophotographic printer are cleaned off.

BACKGROUND ART

Of conventional photoconductor drum cleaning apparatuses of this type, there is one as shown in FIG. 1. Operating with a photoconductor drum a, this photoconductor drum cleaning apparatus includes two cleaning rolls b and c which are juxtaposed with the photoconductor drum a at two vertically spaced positions in a direction in which it is rotated. The cleaning rolls b and c are rotated reversely in direction with respect to the peripheral surface of the rotating photoconductor drum a and in frictional sliding (rubbing) contact with the peripheral surface of the photoconductor drum a. The upper cleaning roll b is constructed of a rubbing body (sponge) d mounted in a layer around an axial member while the lower cleaning roll c is constructed also of a rubbing body (sponge) d mounted in a layer around a cylinder e having its peripheral wall formed with numbers of small hole and its hollow provided with a suction pipe f. The apparatus also includes a spray nozzle g for spraying a cleaning liquid towards the upper cleaning nozzle b, a cleaning blade h disposed between the two cleaning rolls b and c, and cleaning blades i and j disposed in contact with the peripheral surfaces of the cleaning rolls b and c, respectively, for cleaning their surfaces (See JP 2004-271833 A).

The conventional photoconductor drum cleaning apparatus has problem in cost because of two vertically spaced cleaning rolls b and c in its makeup, the upper of which is supplied with cleaning solution. Also, because of the interlocked coupling between the two cleaning rolls b and c, their respective speeds of rotation cannot be adjusted individually so that it is hard to control and optimize rolls' speeds of rotation to follow changes in image recording speed over an entire range of image recording speeds.

Also, a cleaning blade brought into contact with each of surfaces of the two cleaning rolls b and c for cleaning them may damage the surfaces of the cleaning rolls which are composed of sponge.

Further, because of the structure that toner and carrier solutions scraped off by a cleaning blade h interposed between the two cleaning rolls are removed via the lower cleaning roll c, the toner and carrier solution scraped off by the cleaning blade h located above may reattach onto the photoconductor drum a from the lower cleaning roll c, leaving rooms for improvement to achieve a desired cleaning efficiency.

DISCLOSURE OF THE INVENTION

With the abovementioned points taken into account, the present invention has an object to provide a photoconductor drum cleaning apparatus in an electrophotographic printer wherein a single wiping roll is made sufficient to simplify the makeup and whereby a cleaning roll in rubbing contact with the surface of the photoconductor drum can controllably be rotated at a speed that follows a change in image recording speed and the cleaning roll has an extended service life by minimizing a damage on its peripheral surface and whereby there remains a minimum residual amount of toner on the photoconductor drum surface even at a high speed production.

In order to achieve the object mentioned above there is provided in accordance with the present invention a photoconductor drum cleaning apparatus in an electrophotographic printer in which a toner image formed on a photoconductor drum is transferred via a transfer drum onto a recording medium to print an image thereon, characterized in that the apparatus comprises: disposed in order from upstream in the rotation direction of the photoconductor drum, a blade scraper contacting with the surface of the rotating photoconductor drum and a wiping roll rotating reversely in rubbing contact with the surface of the rotating photoconductor drum; disposed upstream of an area of rubbing contact of the rotating wiping roll with the surface of the photoconductor drum, a squeezing roll rotating normally in pressure contact with the surface of the rotating wiping roll; and disposed downstream of an area of rubbing contact of the rotating wiping roll with the photoconductor drum and upstream of the rotating squeeze roll, a brush roll rotating normally or reversely in pressure contact with the surface of the rotating wiping roll, the brush roll having a portion of its outer periphery immersed in a cleaning carrier solution.

Also, in the photoconductor drum cleaning apparatus mentioned above, the brush roll may be rotated reversely with respect to the surface of the wiping roll and the wiping roll, squeezing roll and brush roll interlocked mechanically may be controllably driven by a single motor interlocked therewith.

And, the photoconductor drum cleaning apparatus as mentioned above may further comprise: a guide means disposed under the blade scraper for guiding a solution scraped off by the blade scraper; and a tray disposed under the squeezing roll for accepting a solution squeezed out by the squeezing roll and the solution scraped off from the guide means.

The blade scraper may comprise two blades which are spaced apart from each other in a direction in which the photoconductor drum is rotated.

According to the present invention, a single wiping roll which serves as the cleaning roll in rubbing contact with the photoconductor drum simplifies the makeup of a cleaning apparatus using wiping roll means. Further, where the wiping roll along with the squeezing roll and the brush roll in pressure contact with the wiping roll is driven by a single motor, the speed of rotation of the wiping roll as the cleaning roll for the photoconductor drum can be freely adjusted at an optimum value for rotation of the photoconductor drum.

Also, by cleaning the wiping roll through the squeezing roll and the brush roll each rotating in pressure contact with the wiping roll, the wiping roll can be prevented from damaging by its cleaning, thereby prolonging the service life of the wiping roll.

Further according to the present invention, by having the photoconductor drum cleaned with both of the blade scraper in rubbing contact with the photoconductor drum surface and the wiping roll reversely rotating in rubbing contact with the photoconductor drum surface, it is possible to clean the photoconductor drum surface well to the extent that there remains a minimum residual amount of toner and carrier solution thereon.

And, further according to the present invention, by having the blade scraper constituted by two scraping blades spaced apart from each other in a direction in which the photoconductor drum is rotated, the scraping action by a blade can be doubled, thereby making it possible to achieve an increased cleaning effect.

BEST MODES FOR CARRYING OUT THE INVENTION

Figure 1:
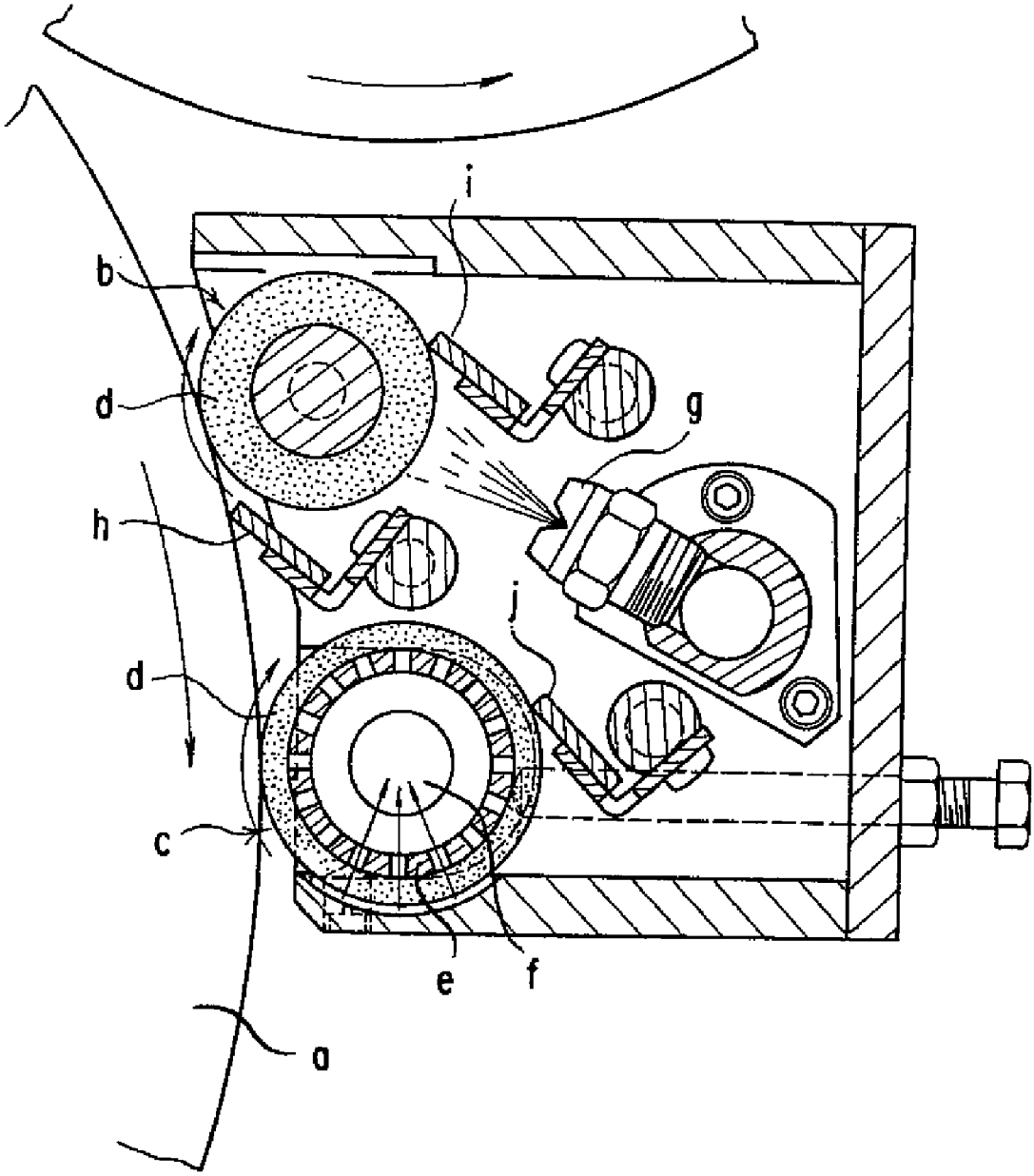
FIG. 1 is a cross sectional view illustrating a conventional photoconductor drum cleaning apparatus.
Figure 2:
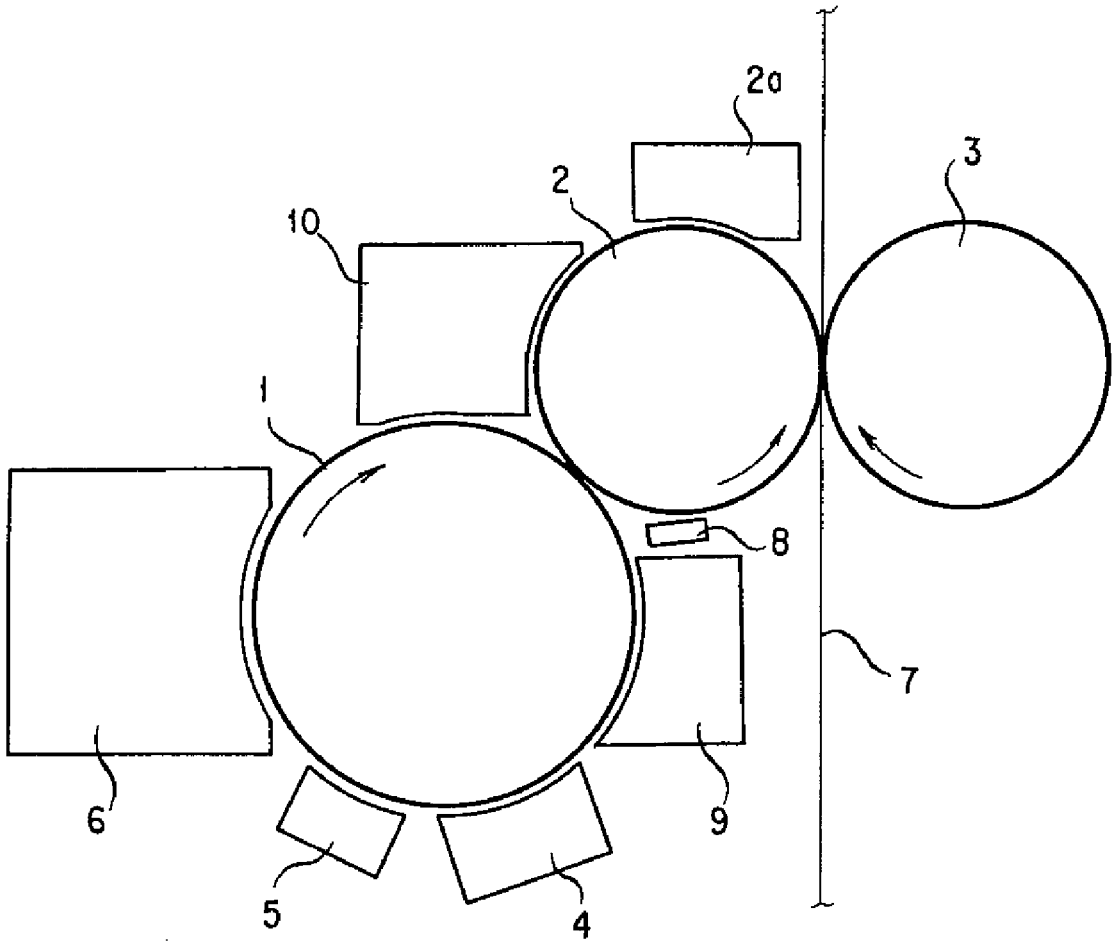
FIG. 2 is an explanatory view illustrating an electrophotographic printer in which the present invention is carried out.

FIG. 2 is an explanatory view illustrating an electrophotographic printer in which the present invention is carried out. As shown, a photoconductor drum 1 is opposite to and in contact with a transfer drum 2 which in turn is opposite to and in contact with a backup roll 3.

In the electrophotographic printer, the photoconductor drum 1 is rotated by a drive means such as a motor (not shown) at a constant speed in a direction of the arrow. The surface of the photoconductor drum 1 is uniformly charged with electricity in the dark by a charging unit 4 and then has an electrostatic latent image formed thereon of an original light figure when irradiated by an exposure unit 5 for image formation. Thereafter, the electrostatic latent image when passing through its processing region is visualized by a developing unit 6, forming a toner image on the surface of the photoconductor drum 1.

The toner image on the surface of the photoconductor drum 1 is primarily transferred on the surface of the transfer drum 2 in its transfer region by a bias voltage applied through the transfer drum 2 and a nip pressure between the drums. This primarily transferred toner image is secondarily transferred in its second transfer region on a recording medium 7 passing through between the transfer drum 2 and the backup roll 3. A carrier solution supply unit 2*a* is also shown supplying the transfer drum 2 with a carrier solution.

The recording medium 7 on which the toner image is secondarily transferred has the toner image fixed thereon by a fixing unit (dryer) not shown and then is discharged out of the printer. On the other hand, after the primary transfer, a residual potential that remains on the photoconductor drum 1 is removed by a static eliminator 8. And, the carrier solution and a residual toner that remain on the photoconductor drum 1 after the primary transfer is completed are removed by a photoconductor drum cleaning apparatus 9 in an area downstream of the static eliminator 8. Note also that s residual toner that remains on the transfer drum 2 is removed by a transfer drum cleaning apparatus 10 to make the transfer drum 2 ready for subsequent image making.

Figure 3:
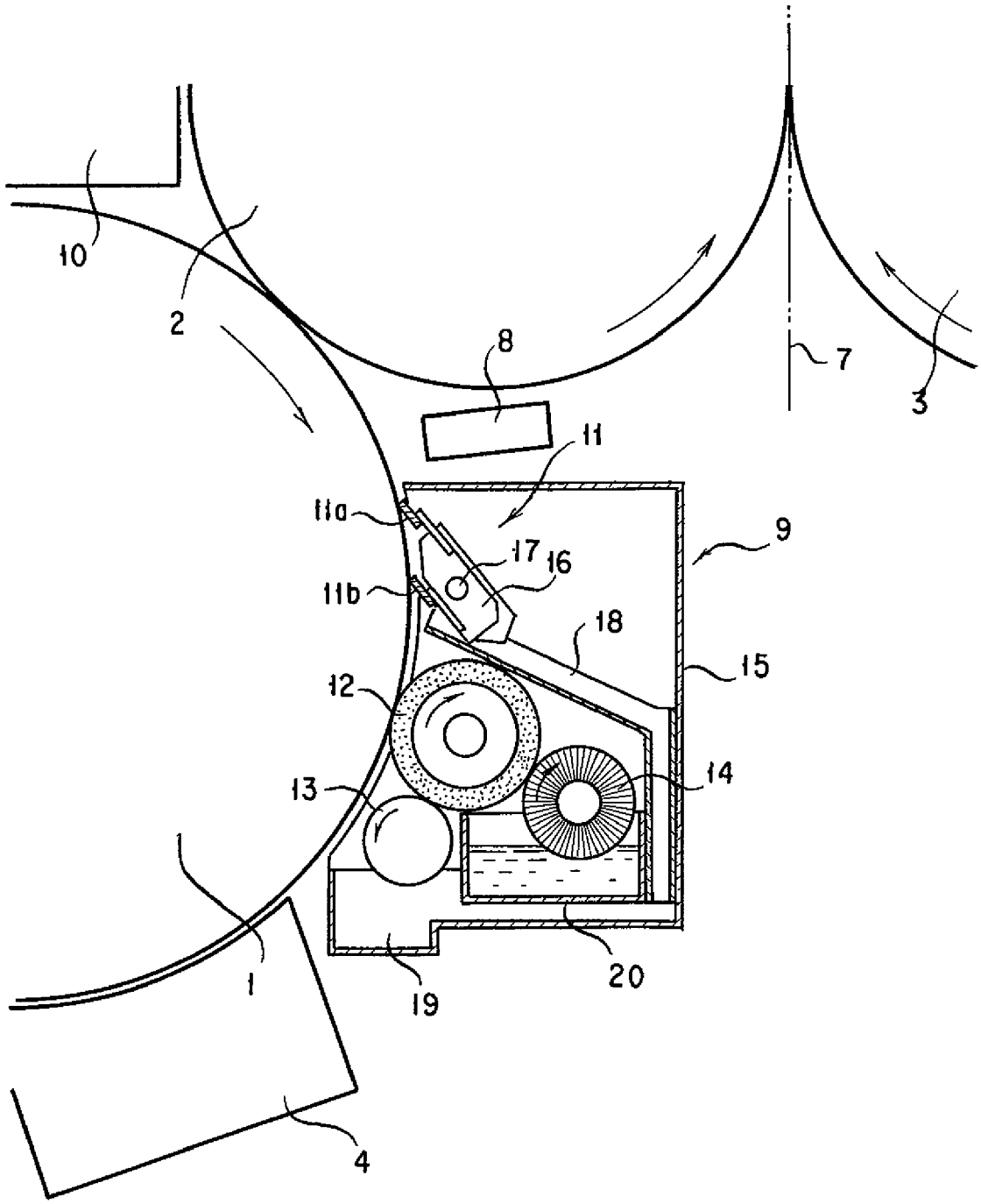
FIG. 3 is a cross sectional view illustrating an essential part of the present invention.

The photoconductor drum cleaning apparatus 9 is so designed and constructed as shown in FIG. 3. As shown in FIG. 3, it comprises a blade scraper 11, a wiping roll 12, a squeezing roll 13, a brush roll 14 and a case 15 to house them.

The blade scraper 11 comprises a pair of blades 11*a* and 11*b* whose ends are in frictional sliding (rubbing) contact with the photoconductor drum 1 and a bracket 16 to which the blades 11*a* and 11*b* are fastened in the state that they are spaced apart in a direction in which the photoconductor drum 1 is rotated. And, the bracket 16 is securely connected to a side of the case 15 via a fastening element 17 such that loosening the fastening element 17 allows the bracket 16 to be rotated for adjusting the strength of pressure contact of the blades 11*a* and 11*b* against the peripheral surface of the photoconductor drum 1. Each of the ends of the blades 11*a* and 11*b* is positioned above a center of rotation of the bracket 16 at the fastening element 17. Thus, with the bracket 16 rotated counterclockwise in FIG. 3, the rubbing force by the two blades 11*a* and 11*b* increases. Then, with the two blades 11*a* and 11*b* spaced apart vertically, the rubbing force by the upstream blade 11*a* positioned upper is greater than that by the downstream blade 11*b* positioned lower.

Disposed under the blade scraper 11 is a guide 18 for accepting a solution scraped off by the scraper blade 11*b*, the guide 18 communicating with a drip tray 19 disposed at the lower part of the case 15.

The wiping roll 12 lies downstream of the blade scraper 11 and is rotated reversely in direction with respect to the peripheral surface of the rotating photoconductor drum 1 while in contact therewith. The wiping roll 12 is formed over its peripheral portion of a sponge and rotated reversely in direction with respect to the peripheral surface of the rotating photoconductor drum 1 to rub and wipe the surface of the photoconductor drum 1.

Disposed under the wiping roll 12, the squeezing roll 13 is in pressure contact with the wiping roll 12 upstream of a point of contact of the wiping roll 12 with the photoconductor drum 1. The squeezing roll 13 is rotated normally in direction with respect to the peripheral surface of the rotating wiping roll 12. Under the squeezing roll 13 there is disposed the drip tray 19 mentioned above.

The brush roll 14 is disposed to contact with the peripheral surface of the wiping roll 12 downstream of an area of rubbing contact of the wiping roll 12 with the photoconductor drum 1 and upstream of the squeezing roll 13 contacting with the wiping roll 12. And, the brush roll 14 is rotated reversely with respect to the surface of the wiping roll 12. Under the brush roll 14 there is disposed a trough 20 for accepting the cleaning carrier solution and a lower part of the brush roll 14 is immersed in the carrier solution in the trough 20.

The wiping roll 12, the squeezing roll 13 and the brush roll 14 are interlocked together by a gear mechanism and driven by a single motor (not shown) as their common drive source whose speed of rotation can freely be controlled and the wiping roll 12 can controllably be rotated to follow rotation of the photoconductor drum 1 or can freely be set at an optimum speed of rotation for rotation of the photoconductor drum 1.

In the makeup mentioned above, as the photoconductor drum 1 rotates, the wiping blade scraper 11 scrapes off the carrier solution and the residual toner remaining on the surface of the photoconductor drum 1 after they are diselectrified by the static eliminator 8. Then, the residual toner on the surface of the photoconductor drum 1 has its major part together with the carrier solution scraped off by the two scraping blades 11*a* and 11*b*. The toner scraped off together with the carrier solution is led through the guide 18 into the tray 19.

The surface of the photoconductor drum 1 subsequently is brought into rubbing contact with the reversely rotating wiping roll 12 whereby fine residual toner particles and carrier solution which have not be taken off by the blade scraper 11 are wiped off by the wiping roll 12. And, the wiping roll 12 contaminated by wiping on is cleaned with the rotating brush roll 14 in pressure contact with the wiping roll 12 and a cleaning carrier solution supplied through the brush roll 14. And, the cleaning carrier solution supplied onto the wiping roll 12 from the brush roll 14 is squeezed out by the squeezing roll 13 before the wiping roll 12 is brought into rubbing contact with the photoconductor drum 1. The carrier solution squeezed out is discharged through the tray 19 into the outside.

While in the form of implementation described above, the blade scraper 11 is shown comprising two scraping blades 11*a* and 11*b*, they may be replaced by one or three or more blades.

The brush roll 14 may be rotated normally with respect to the rotating wiping roll 12. Then, the brushing roll 14 may either its power transmission system altered or be driven by the single motor. Note that each of the wiping roll 12, the brush roll 14 and the squeezing roll 13 may be driven by a single motor whose rotation is controllable.

What is claimed is:

1. A photoconductor drum cleaning apparatus in an electrophotographic printer in which a toner image formed on a photoconductor drum is transferred via a transfer drum onto a recording medium to print an image thereon, wherein the apparatus comprises:

disposed in order from upstream in the rotation direction of the photoconductor drum, a blade scraper contacting with the surface of the rotating photoconductor drum and a wiping roll rotating reversely in rubbing contact with the surface of the rotating photoconductor drum;

disposed upstream of an area of rubbing contact of the rotating wiping roll with the photoconductor drum, a squeezing roll rotating normally in pressure contact with the surface of the rotating wiping roll; and disposed downstream of an area of rubbing contact of the rotating wiping roll with the photoconductor drum and upstream of the rotating squeeze roll, a brush roll rotating normally or reversely in pressure contact with the surface of the rotating wiping roll, the brush roll having a portion of its outer periphery immersed in a cleaning carrier solution.

2. A photoconductor drum cleaning apparatus in an electrophotographic printer as set forth in claim 1, wherein the brush roll is rotated reversely with respect to the surface of the wiping roll and the wiping, squeezing and brush rolls interlocked mechanically are controllably driven by a single motor interlocked therewith.

3. A photoconductor drum cleaning apparatus in an electrophotographic printer as set forth in claim 2, further comprising:

a guide means disposed under the blade scraper for guiding a solution scraped off by the blade scraper; and a tray disposed under the squeezing roll for accepting a solution squeezed out by the squeezing roll and the solution scraped off from the guide means.

4. A photoconductor drum cleaning apparatus in an electrophotographic printer as set forth in claim 3, wherein the blade scraper comprises two blades which are spaced apart from each other in a direction in which the photoconductor drum is rotated.

5. A photoconductor drum cleaning apparatus in an electrophotographic printer as set forth in claim 1, further comprising:

a guide means disposed under the blade scraper for guiding a solution scraped off by the blade scraper; and a tray disposed under the squeezing roll for accepting a solution squeezed out by the squeezing roll and the solution scraped off from the guide means.

6. A photoconductor drum cleaning apparatus in an electrophotographic printer as set forth in claim 5, wherein the blade scraper comprises two blades which are spaced apart from each other in a direction in which the photoconductor drum is rotated.

7. A photoconductor drum cleaning apparatus in an electrophotographic printer as set forth in claim 2, wherein the blade scraper comprises two blades which are spaced apart from each other in a direction in which the photoconductor drum is rotated.

8. A photoconductor drum cleaning apparatus in an electrophotographic printer as set forth in claim 1, wherein the blade scraper comprises two blades which are spaced apart from each other in a direction in which the photoconductor drum is rotated.

* * * * *